US006068139A

United States Patent [19]

Brozak, Jr.

[11] Patent Number: 6,068,139

[45] Date of Patent: May 30, 2000

[54] RETAIL PRODUCT DISPLAY SYSTEM

[75] Inventor: Emory Brozak, Jr., Strongsville, Ohio

[73] Assignee: American Greetings Corporation, Cleveland, Ohio

[21] Appl. No.: 09/100,378

[22] Filed: Jun. 19, 1998

[51] Int. Cl.[7] ..... A47F 5/00

[52] U.S. Cl. ..... 211/59.2; 211/47; 211/169; 312/72; 40/124.2

[58] Field of Search ..... 211/59.2, 45, 47, 211/48, 128.1, 129.1, 169, 168, 96; 312/45, 72; 40/124.2

[56] References Cited

U.S. PATENT DOCUMENTS

| | | | |
|---|---|---|---|
| D. 327,590 | 7/1992 | Hardy | D6/454 |
| D. 337,676 | 7/1993 | Hardy | D6/491 |
| D. 365,706 | 1/1996 | Campbell . | |
| D. 365,707 | 1/1996 | Campbell . | |
| 3,200,958 | 8/1965 | Hudgeons et al. | 211/169 X |
| 3,393,808 | 7/1968 | Chirchill . | |
| 3,986,756 | 10/1976 | Kranich . | |
| 4,175,807 | 11/1979 | Kranich et al. . | |
| 4,433,883 | 2/1984 | Boender et al. . | |
| 4,848,855 | 7/1989 | Cone . | |
| 4,936,468 | 6/1990 | McNabb . | |
| 5,031,781 | 7/1991 | Price et al. . | |
| 5,139,155 | 8/1992 | Laxsor | 211/169 |
| 5,284,257 | 2/1994 | Schum . | |
| 5,292,015 | 3/1994 | Bumbera . | |
| 5,499,726 | 3/1996 | Mitchell . | |
| 5,782,366 | 7/1998 | Garza | 211/169 X |

*Primary Examiner*—Robert W. Gibson, Jr.
*Attorney, Agent, or Firm*—Calfee, Halter & Griswold LLP

[57] ABSTRACT

An adaptable retail merchandise product display system is particularly suited for display and storage of printed media in planar or roll form. The system includes display cassettes supported in tiers in a cabinet or rack; adjustable roll trays which accommodate rolled merchandise in various roll widths and also supported in tiers in a cabinet or rack; a fin to support merchandise displays and with integral storage compartments; and display spinners having a central vertical axis and radially extended attachment points between which display media extends in a concave form to maximize displayed surface area. The various aspects of the adaptable display can be combined in different arrangements according to the type of merchandise and the retail environment.

20 Claims, 9 Drawing Sheets

RETAIL PRODUCT DISPLAY SYSTEM

FIELD OF THE INVENTION

The present invention pertains generally to merchandise display and related hardware for displaying products in a retail environment and more particularly, to retail product display systems which are selectively configurable to display cylindrical objects such as wallpaper, wrapping paper or greeting card products in interchangeable arrangements.

BACKGROUND OF THE INVENTION

Prior art wallpaper sample books have been typically used by retailers to allow consumers to view a plethora of wallpaper samples. The books are large and difficult to handle, and the wallpaper samples can be viewed only by opening the book on a large table. Several tables of book stands are required for each store. Another disadvantage to this method is that only a few samples can be displayed at any given time, and it requires the time-consuming effort and patience of the consumer to thumb through the sample books. Another disadvantage to this method is that the consumer cannot retain a sample for their personal use and instead must borrow the sample book in order to effectively coordinate colors. Further, the consumer requires the assistance of a sales clerk to order the wallpaper.

More recently, a do-it-yourself concept in marketing wallpaper has resulted in the display of wallpaper samples and wallpaper rolls such as that shown in U.S. Pat. Nos. 4,121,718, 4,175,807 and 5,031,781. Many prior art display racks have the disadvantage of providing the display of only a fixed width of wallpaper. Rolls of wallpaper vary in width and size which will result in a waste of space when used in the prior art display racks. Thus for example, it is not generally feasible to display wallpaper rolls on display racks adjacent matching border rolls because of the huge disparity in widths. Another disadvantage to the prior art display racks is that they generally do not provide for the display of more than one type of wallpaper in a row. Further, the prior art display racks generally do not provide for an easily accessible and removable sample adjacent the wallpaper roll.

It is often desirable to display just the wallpaper samples in a large array in an easily retrievable and aesthetically-pleasing manner. The wallpaper sample displays of the prior art are disadvantageous in that they require the customer to hunt and retrieve the desired sample after viewing a large static display of samples.

SUMMARY OF THE PRESENT INVENTION

The present invention overcomes these and other disadvantages of the prior art, while providing a wallpaper roll assembly which can accommodate wallpaper rolls of varying widths in a single row or even in adjacent rows. The invention also provides for the storage and display of several rolls of wallpaper of varying widths contained within in its own independent adjustable width carrier. Further it is desirable to provide for an easily accessible sample adjacent the displayed wallpaper roll. The present invention further provides a space-efficient display of samples.

The invention provides in one aspect a display system for storing merchandise such as wallpaper samples or greetings cards comprising one or more vertical display columns comprised of opposed sidewalls with each sidewall having a bracket affixed thereto. Each of the brackets have aligned terraced slots for receiving one or more cassettes with each of the cassettes comprising one or more compartments for receiving merchandise.

The invention provides in another aspect a display system for storing and displaying cylindrical articles comprising a plurality of roll trays for supporting cylindrical objects arranged in one or more vertical columns and affixed to a frame. Each of the roll trays have a front portion comprised of a transparent material sufficient for viewing an exterior surface of the cylindrical objects.

The invention provides in yet another aspect a display system for storing and displaying cylindrical articles comprising a plurality of roll trays for supporting cylindrical objects arranged in one or more vertical columns and affixed to a frame. Each of the roll trays have means for supporting cylindrical articles in one or more adjustable width bins.

The invention provides in still another aspect a tray for supporting two or more types of cylindrical objects of the same or differing widths comprising a first and second pair of support trays slidably mounted on a panel having a track comprised of spaced teeth with grooves therebetween. Each of the support trays have a resilient flap with a ratchet member being positionable in said grooves.

The invention provides in still another aspect a fin assembly for displaying and storing wallpaper samples and the like, the assembly comprising a pivotally mounted elongate mounting panel having a first side and a second side. Each side has an outer display compartment for displaying samples and an interior compartment having one or more pockets for storing consumer samples.

The invention provides in still another aspect a carousel display spinner comprising a plurality of rigid panels arranged to extend radially outward from a vertical axis. A flexible panel is affixed to adjacent radial ends of the rigid panels forming a wide area concave display surface and with all of the panels being rotatably mounted upon a base.

These and other aspects of the invention are herein described in particularized detail with reference to the accompanying Figures.

DETAILED DESCRIPTION OF THE INVENTION

Figure 1:
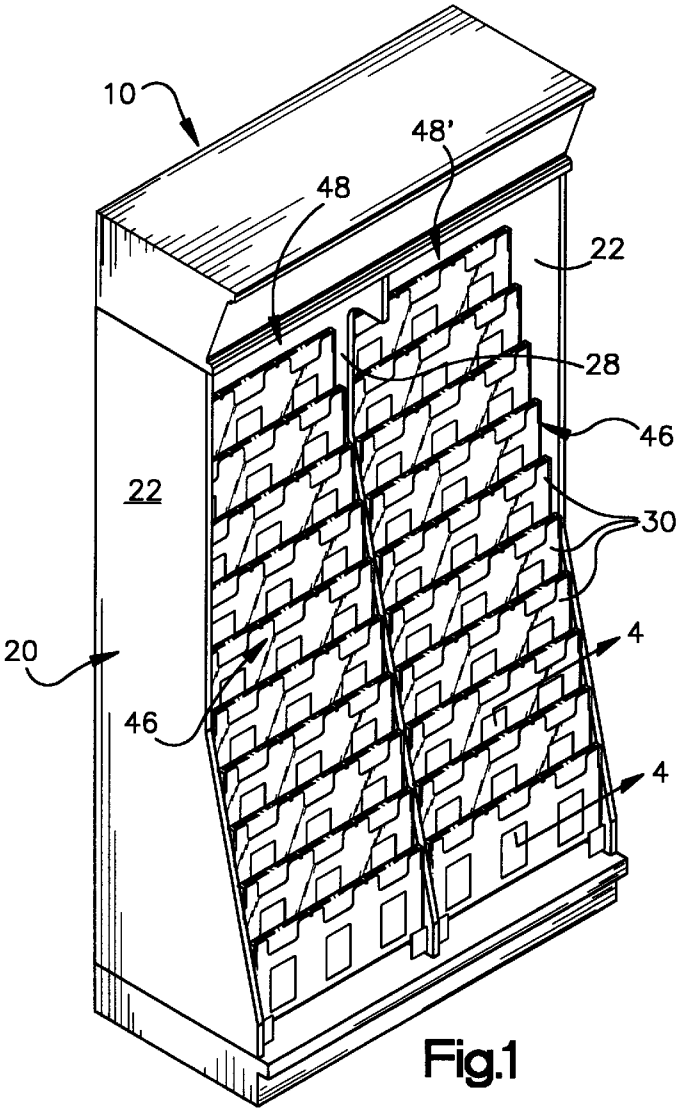
FIG. 1 is a perspective view of a wall paper cassette cabinet constructed in accordance with the present invention.

Referring now to the drawings and in particular to FIG. 1, a cassette display cabinet is shown generally at 10 and which is suitable for, but not limited to, displaying generally planar objects, such as for example, greeting cards, wrapping paper, other printed media, material samples such as wallpaper samples. The display system 10 is comprised of a frame 20 and a plurality of sample cassettes 30 which are arranged in a terraced manner. The frame 20 is made of a pair of opposed sidewalls 22 having a lower portion 24 which gradually tapers from the bottom 26 to the mid-section 27 of the frame 20. Alternatively, the opposed sidewalls 22 may gradually taper upwardly the entire vertical dimension of the display 10. The frame 20 may also contain a header 40 which may optionally contain a partially concealed fluorescent light (not shown) located behind a front panel 44 which may optionally have advertising indicia (Not shown). The merchandise display frame 20 may be dimensioned at any desired width and vertical extent in order to fit within and optimize a product display area in a store. FIG. 1 represents only one possible combination of the frame, array of columns and vertical support wall. Other similar hardware can be used to form a merchandise display wall in accordance with the invention.

The cassette display cabinet 10 as shown in FIG. 1 further contains an open front section 46 for displaying two terraced columns 48, 48' of cartridges 30, although one or more columns may be used. If two or more columns 48 are utilized, the frame 20 further contains an intermediate support wall 28 interdisposed between the adjoining columns. A back wall 50 interconnects the side walls 22 and the intermediate support walls 28 by any suitable fastening method such as screws in conjunction with support brackets or other suitable means well known in the art.

Figure 2:
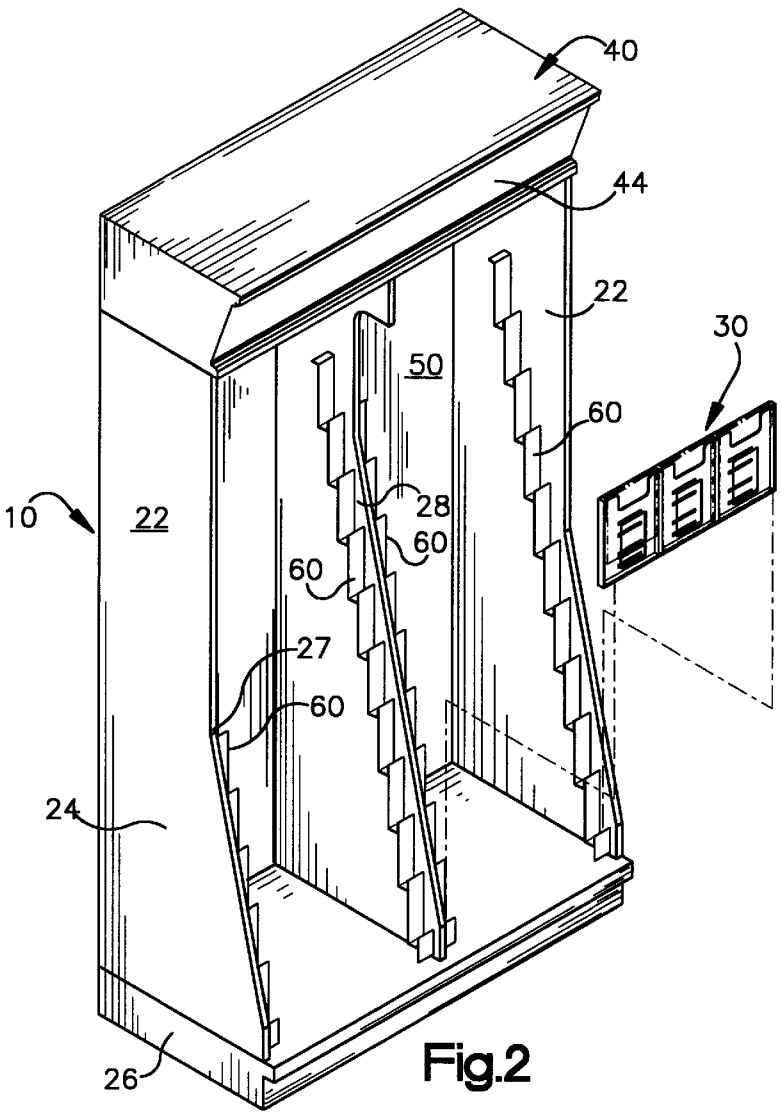
FIG. 2 is a perspective view of the wall paper cassette cabinet of FIG. 1, shown with the cassettes removed.
Figure 4:
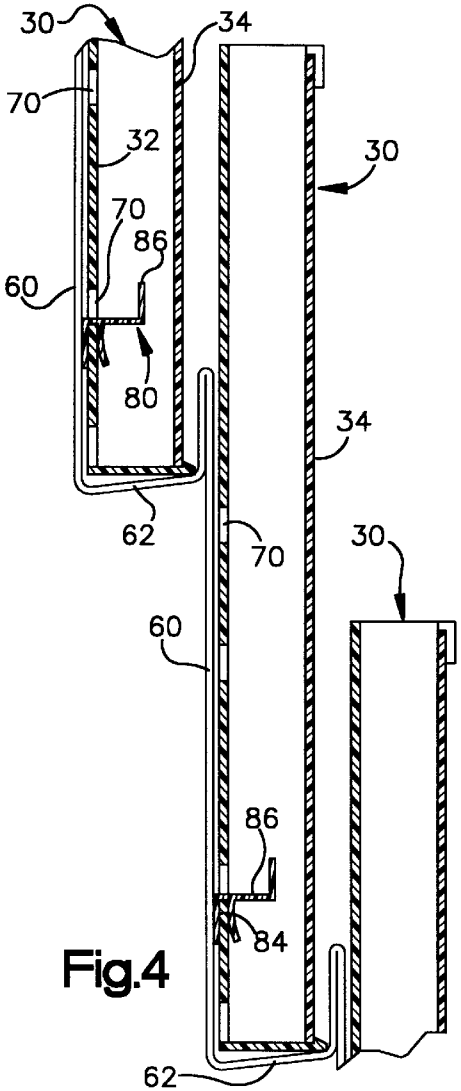
FIG. 4 is a cross-sectional view in the direction 4—4 of FIG. 1 showing the cassette mounted in the cabinet.

Each vertical column 48 has two wallpaper cassette support brackets 60 which are made of metal or wood and are affixed to the adjacent wall 22,28 with any suitable method such as fasteners and mounting brackets (not shown). As shown in FIGS. 2 and 4, the wallpaper cassette support brackets 60 are preferably made of a single metal strip which has been formed in the shape of a series of l-shaped slots 62 arranged in a terraced configuration. A first and second cassette support brackets 60 has aligned L-shaped slots 62 to receive and hold a wallpaper sample cassette 30.

Figure 3:
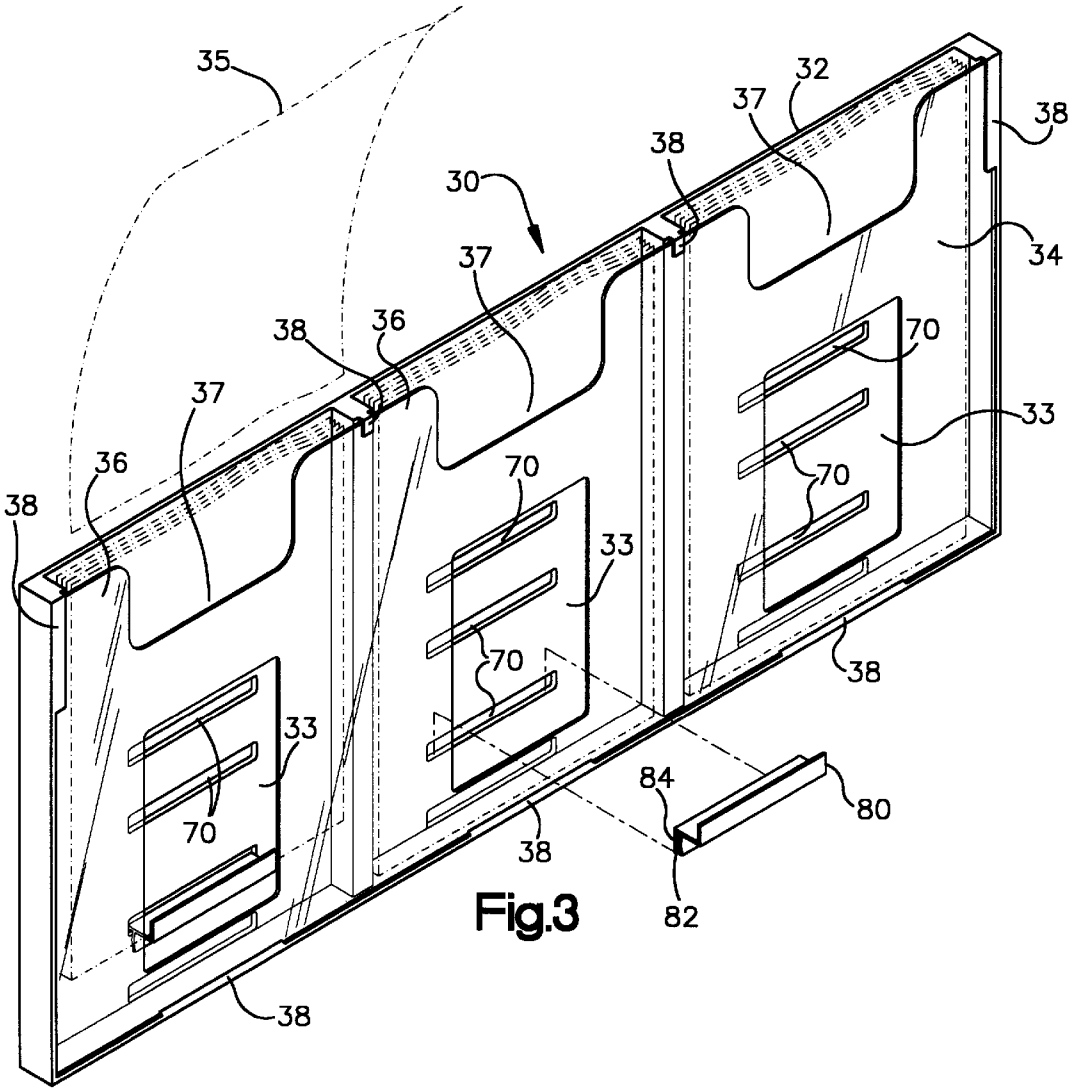
FIG. 3 is a perspective view of the cassette of the cassette cabinet as shown in FIG. 1.

The wallpaper sample cassette 30 as shown in FIG. 3 is made of an outer plastic or metal backing 32 having upper and lower retaining clips 38 into which outer flanges 36 of a clear plastic cover 34 snap fit therein. The cover 34 has optional openings 33 for allowing consumers to touch the exterior surface of the wallpaper sample 35 as well as facilitate removal and installation of the adjustment clip 80 from the cassette 30. The clear plastic cover 34 has outer flanges 36 which are slidably mounted underneath upper and lower retaining clips 38 of the outer backing 32. The clear plastic cover 34 additionally comprises cutouts 37 for facilitating easy removal of the sample 35 from the cassette 30. The sample cassette 30 is divided into two or more compartments 39 formed by spacers 41 for containing and displaying a wallpaper sample 35. The outer backing 32 comprises one or more slots 70 for receiving an adjustment clip 80, which provides for the adjustment of wallpaper samples of varying heights. The adjustment clip 80 is utilized to vary the vertical height of the compartment 39 such that samples of varying widths may be easily retrieved. The adjustment clip 80 comprises a distal end 82 having a first and second member which cooperate to form a clip 84 for retention about the slot 70 of the cassette 30. The opposing end of the adjustment clip 80 cooperates with the cassette outer backing 32 to form a L-shaped support shelf 86 for retaining the samples 35 within the compartment 39. The adjustment clips 80 allow the depth of the compartment 39 to be varied in order to display samples of varying dimensions with the same vertical height in a consistent esthetically pleasing manner.

As shown in FIG. 2, a plurality of sample cassettes 30 are mountable and removable within a column of the display system 10. Each cassette 30 is slidably insertable into the aligned L-shaped slots of the support brackets 60.

Figure 5:
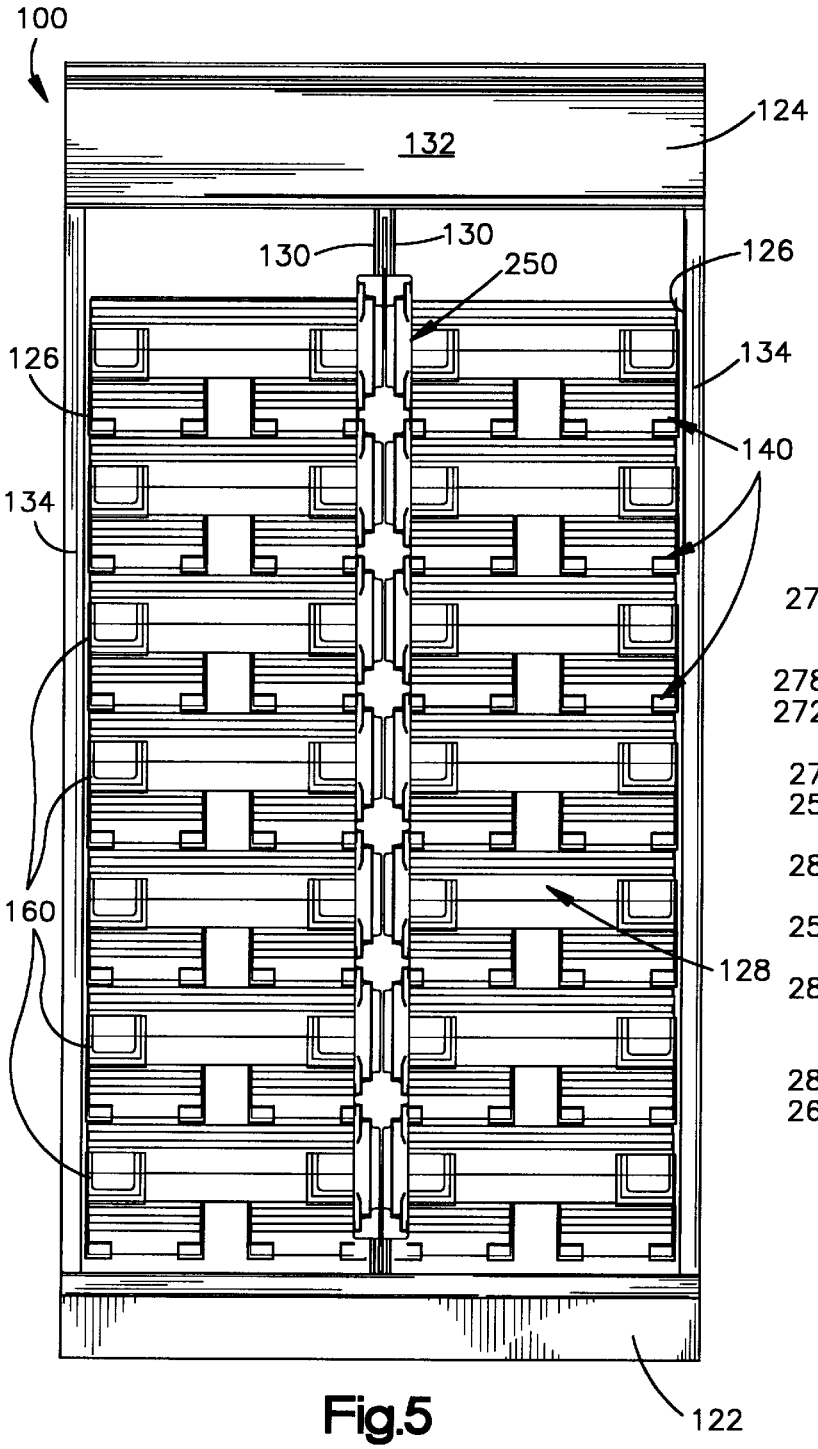
FIG. 5 is a front view of a second embodiment of a roll display cabinet constructed in accordance with the present invention.

FIG. 5 illustrates a second embodiment of the invention with a combined wallpaper sample and wallpaper roll display system 100. The roll display cabinet 100 has a base 122, a header 124 and opposed side frames 126 mounted therebetween with an open frontal display area 128. The header 124 may optionally contain a partially concealed fluorescent light (not shown) located behind a front panel 132 which may also have advertising indicia (not shown). Side and rear aesthetically pleasing wood or plastic panels 134 may be mounted on the side frames 126. The display area 128 may be further divided into one or more columns by a pair of adjacent intermediate support frames 130. The column width may be varied in order to display different widths of cylindrical rolls. Within each display column a plurality of roll bins are mounted as shown in FIG. 5. FIG. 5 illustrates two types of roll trays or bins: an adjustable width roll tray 140 and a fixed width sample pocket tray 160.

Figure 6:
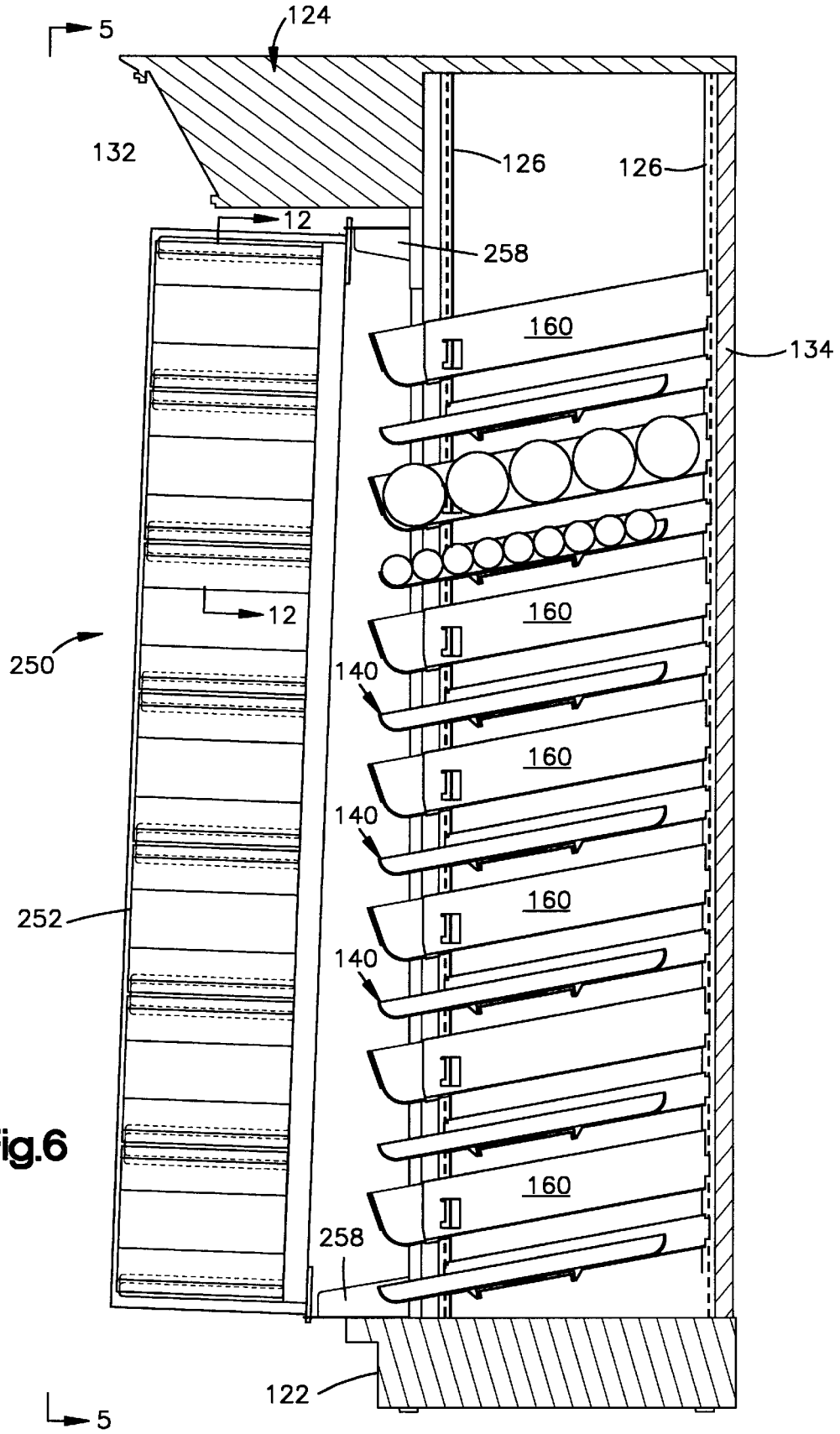
FIG. 6 is a side view of the roll display cabinet as shown in FIG. 5.
Figure 7:
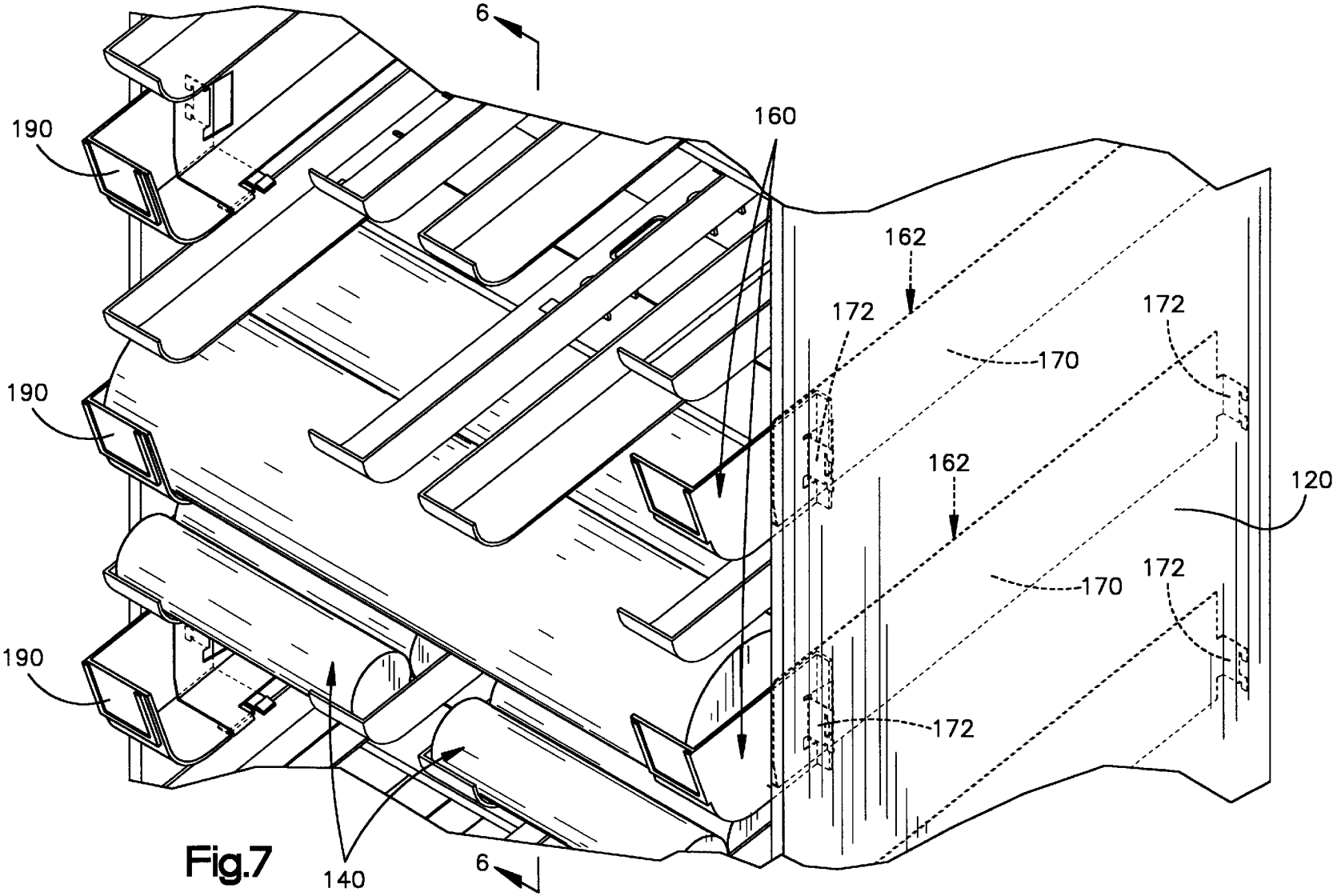
FIG. 7 is an enlarged perspective view of a portion of the roll display cabinet as shown in FIG. 5.
Figure 8:
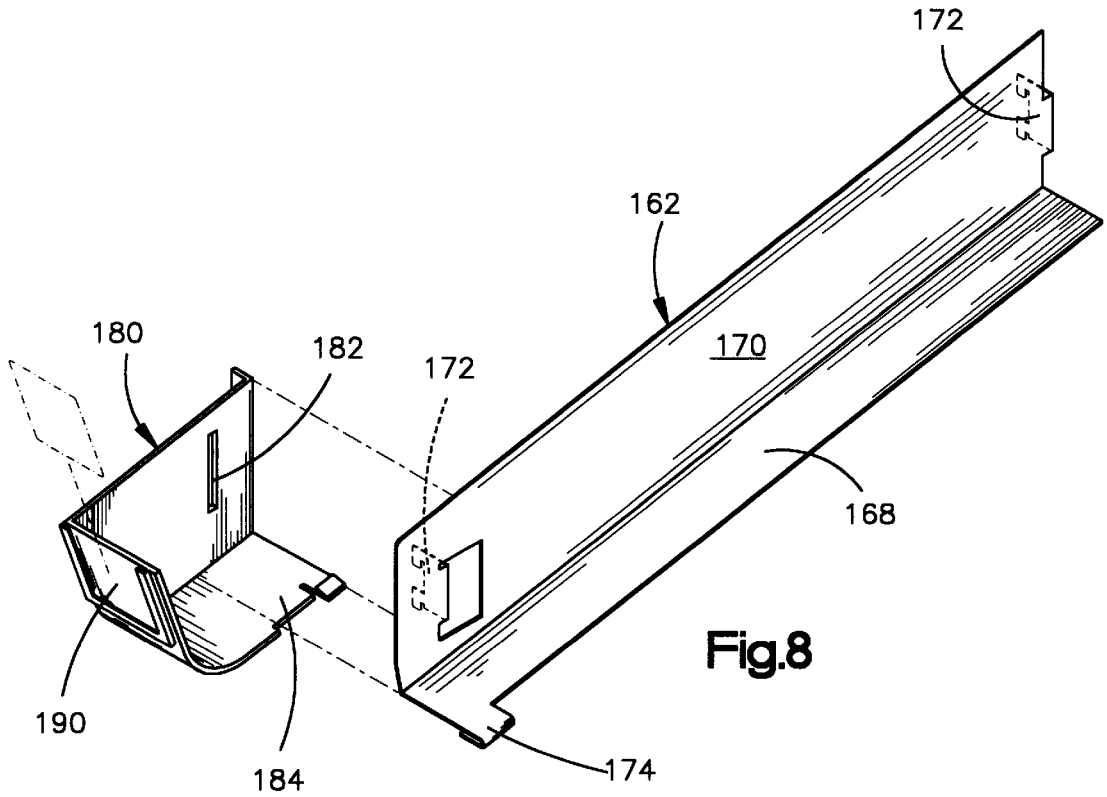
FIG. 8 is a perspective exploded view of a fixed-width roll tray as shown in FIG. 5.

As best shown in FIGS. 6, 7 and 8, the fixed width roll tray 160 contains a left and right roll tray bracket 162, 164 respectively, which cooperate together to form a bin for supporting and displaying cylindrical rolls 166 such as wall paper and wrapping paper. Each roll tray bracket 162,164 has a planar bottom wall 168 and side wall 170 joined together such that the walls are perpendicular with respect to each other. Each left and right roll tray bracket 162,164 has a front section 180 which is preferably made of a hard clear plastic sufficient for viewing and displaying the cylindrical roll. The front section 180 is attached to the walls 168,170 via any conventional means known in the art. Preferably, the front section 180 has a rectangular slot 182 located on an exterior surface for receiving a mounting bracket 172 located therein. The bottom wall 168 further comprises a retaining flap or hook 174 for reception of a planar surface 184 of the front section 180. The front section 180 further comprises a pocket 190 for storing a plurality of merchandise samples or displaying advertising or pricing information.

As shown in FIG. 6, each roll tray bracket 162,164 is mounted in an angled manner utilizing the brackets 172 positioned within slots of the frame 126. Thus the roll tray brackets are aligned and angled such that a plurality of wallpaper brackets cooperate to form a plurality of vertically-spaced wallpaper roll trays or bins that are tilted forward to facilitate removal of the rolls by consumers from the trays.

Figure 10:
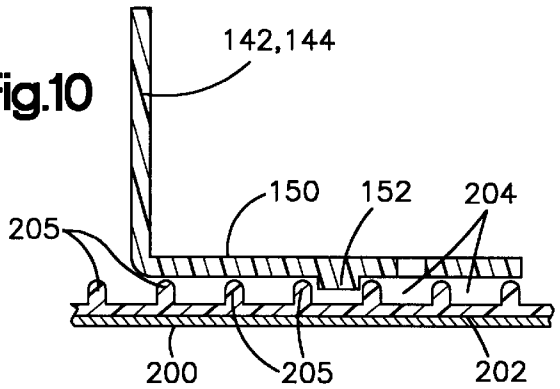
FIG. 10 is an enlarged cross-sectional view in the direction 10—10 of FIG. 9 of a section of the roll tray and cabinet configured in accordance with the present invention.
Figure 9:
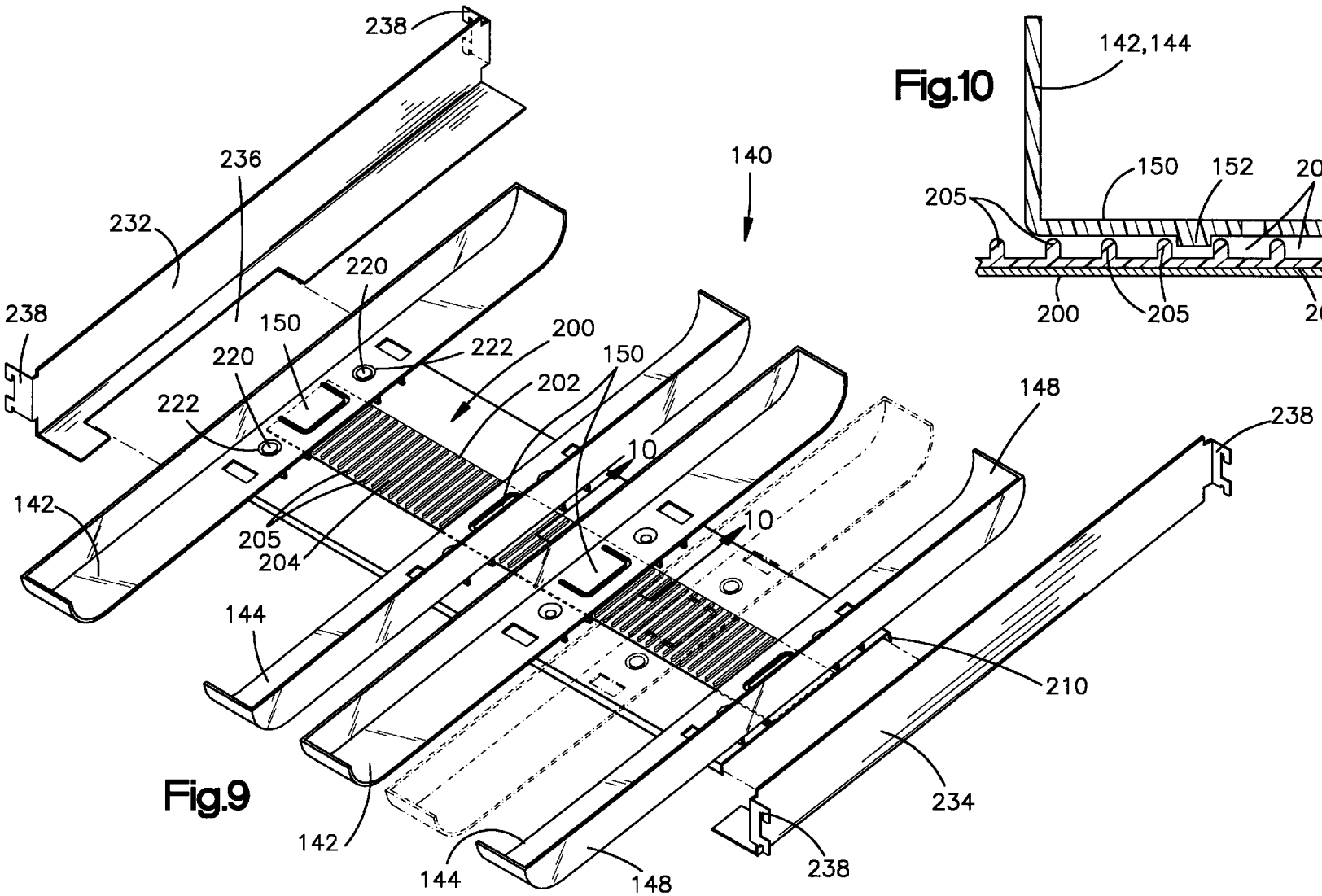
FIG. 9 is a perspective view of an adjustable roll tray and mounting brackets of the present invention as shown in FIG. 5.
Figure 11:
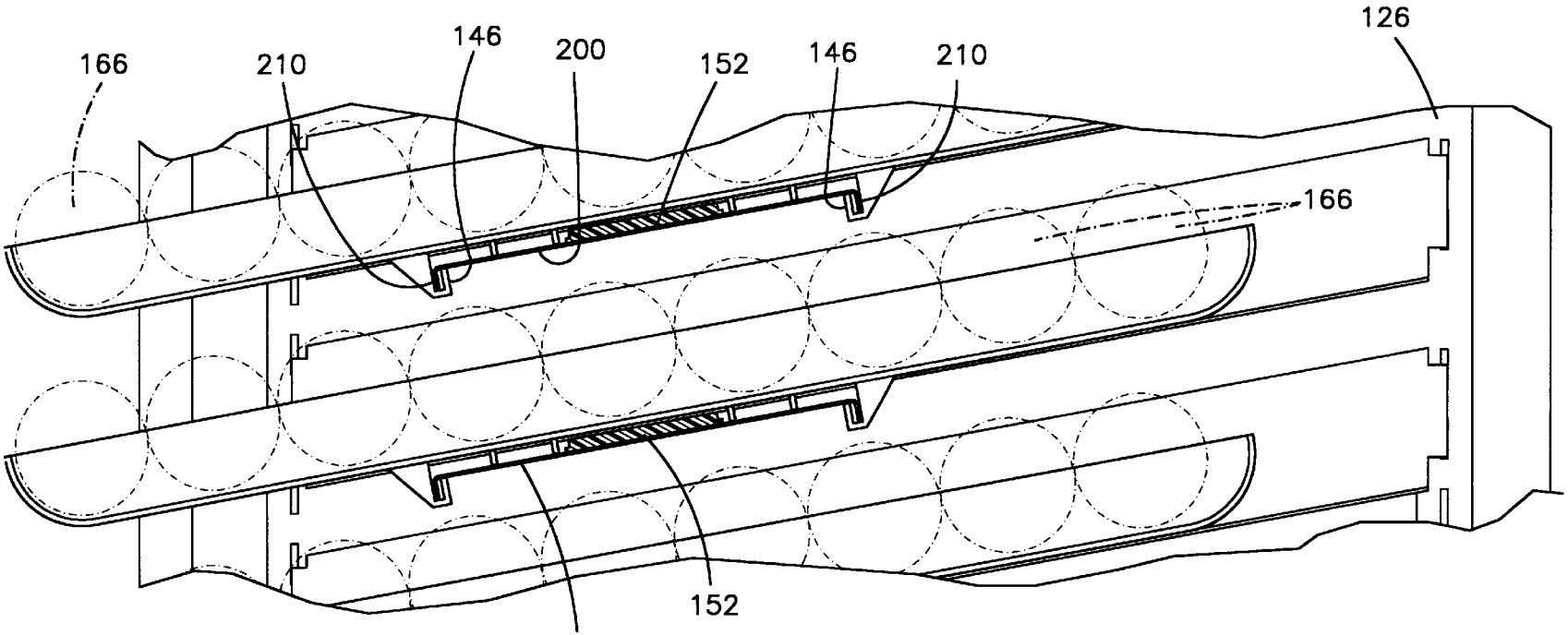
FIG. 11 is an enlarged cross-sectional view in the direction 11—11 of FIG. 9 of a section of the roll tray and cabinet configured in accordance with the present invention.

The display system 100 may additionally contain an adjustable width roll tray 140 as best shown in FIG. 9, which is especially suited for displaying border wallpaper rolls which have a much shorter width and come in non-standard sizes than regular wallpaper. The wallpaper tray 140 may comprise only a single bin of wallpaper rolls, or may comprise two or more bins of border rolls, with each bin having an adjustable width. The adjustable wallpaper tray 140 comprises one or more left support trays 142 and a matching right support tray 144. The left and right support trays 142,144 are identical mechanically except for being the mirror image of each other, and which cooperate to define a wallpaper or border support tray. The support trays 142, 144 may be comprised of any suitable plastic or metal material, and preferably, a clear hard plastic. Each of the support trays 142, 144 are slidably mounted upon a panel 200 having a track 202 of spaced grooves 204 and teeth 205. The panel 200 further comprises angled edges 210 for being slidably received in the hooked ends 146 of the support trays 142,144, as best shown in FIG. 10. Each support tray 142,144 comprises a planar tray 146 having curved ends 148 with a resilient flap 150 having a ratchet member 152 on the underside for being positionable in the grooves 204 between the teeth 205. A small clearance between the angled surface 210 and the hooked end is desired in order to facilitate the sliding motion of the support tray along the grooved track. The desired when the support tray is lifted slightly in order to disengage the ratchet member 152 from the teeth. The clearance must not be too great in order to retain the ratchet member 152 within the groove between adjacent teeth when the support tray has been adjusted to the desired location. The support trays 142,144 mounted upon the ends of the panel 200 may be fixed into position by insertion of plastic push-in fasteners 220 into holes 222 of the support tray 142,144 and the panel holes (not shown) of the panel 200.

Left and right hand mounting brackets 232, 234 are utilized to mount the wallpaper tray 140 into the frame 126 of the display 100. The angled mounting brackets each have a cutout 236 for inserting the panel 200 therein. The side brackets 238 are then mounted and secured into frame 126 slots of the display 100.

Figure 12:
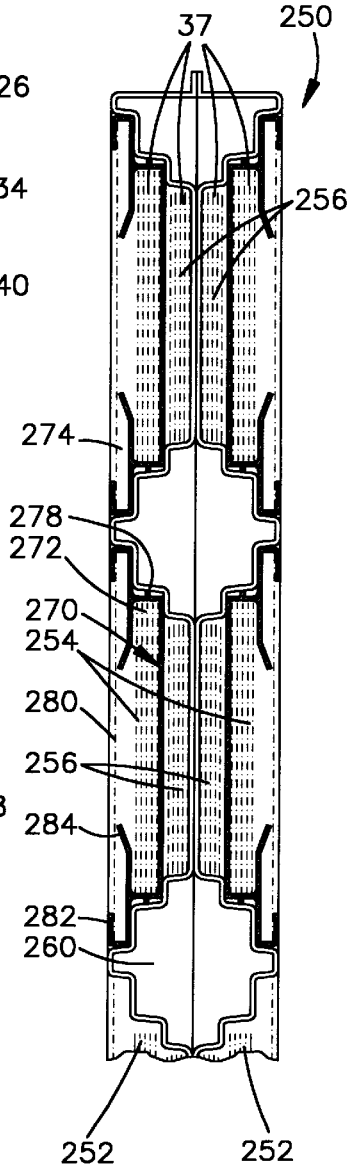
FIG. 12 is a greatly enlarged cross-sectional view in the direction 12—12 of FIG. 11.

As shown in FIGS. 5, 6 and 12, the roll display cabinet 100 may additionally comprise a rotatable fin assembly 250 comprising a vertical display of wallpaper samples 35 with wallpaper samples 37 for consumer's use located behind the display sample in pockets 254 and 256. The advantage to using a rotatable fin assembly in conjunction with a series of wallpaper trays is that the consumer may quickly view and rotate the fin assembly 250 to view the desired samples and then easily retrieve the co-located desired wallpaper rolls and sample swatches. The fin assembly 250 comprises two elongate mounting panel 252 mounted back-to back as shown in FIG. 12 in order to have a double-sided display. The assembled panels 252 are pivotally mounted via a pair of brackets 258 onto the roll display cabinet 100. Each panel 252 further comprises a series of stepped spacers 260 mounted thereon. A plurality of sample separator clips 270 are mounted in between spacers 260 as explained in more detail below.

The sample clip 270 is comprised of any suitable material and is preferably comprised of a hard clear plastic. The clip 270 further comprises an inner compartment 272 and an outer compartment 274 for housing wallpaper samples. The sample clip 270 is mounted onto the panel 260 by friction pins 276 located on the exterior of the inner compartment 272 which are inserted into holes in the middle step 278 of spacer 260.

A display wallpaper sample 35 or combination of samples such as a border and matching wallpaper sample are housed within the first compartment behind a clear plastic cover which is inserted into the outer compartment 274. The clear cover 280 is held in place by flanges 282 and the resilient member 284 which pushes the sample 35 and cover 280 against the flanges 282. The wallpaper samples 37 for consumer's use are located behind the display sample 37 in the pockets 254 and 256 formed by the sample clip 270. Further, the wallpaper rolls which correspond with the wallpaper samples are located next to the fin assembly for ease of retrieval by the consumer.

Figure 14:
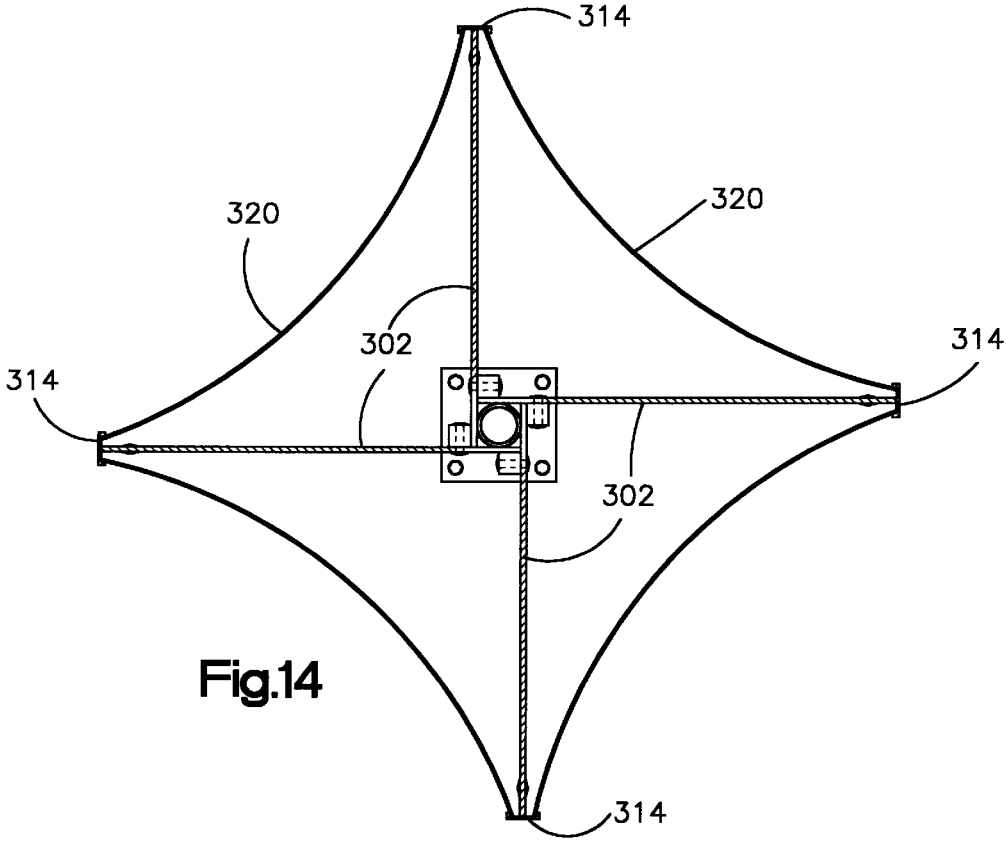
FIG. 14 is a top view of the carousel as shown in FIG. 13.
Figure 13:
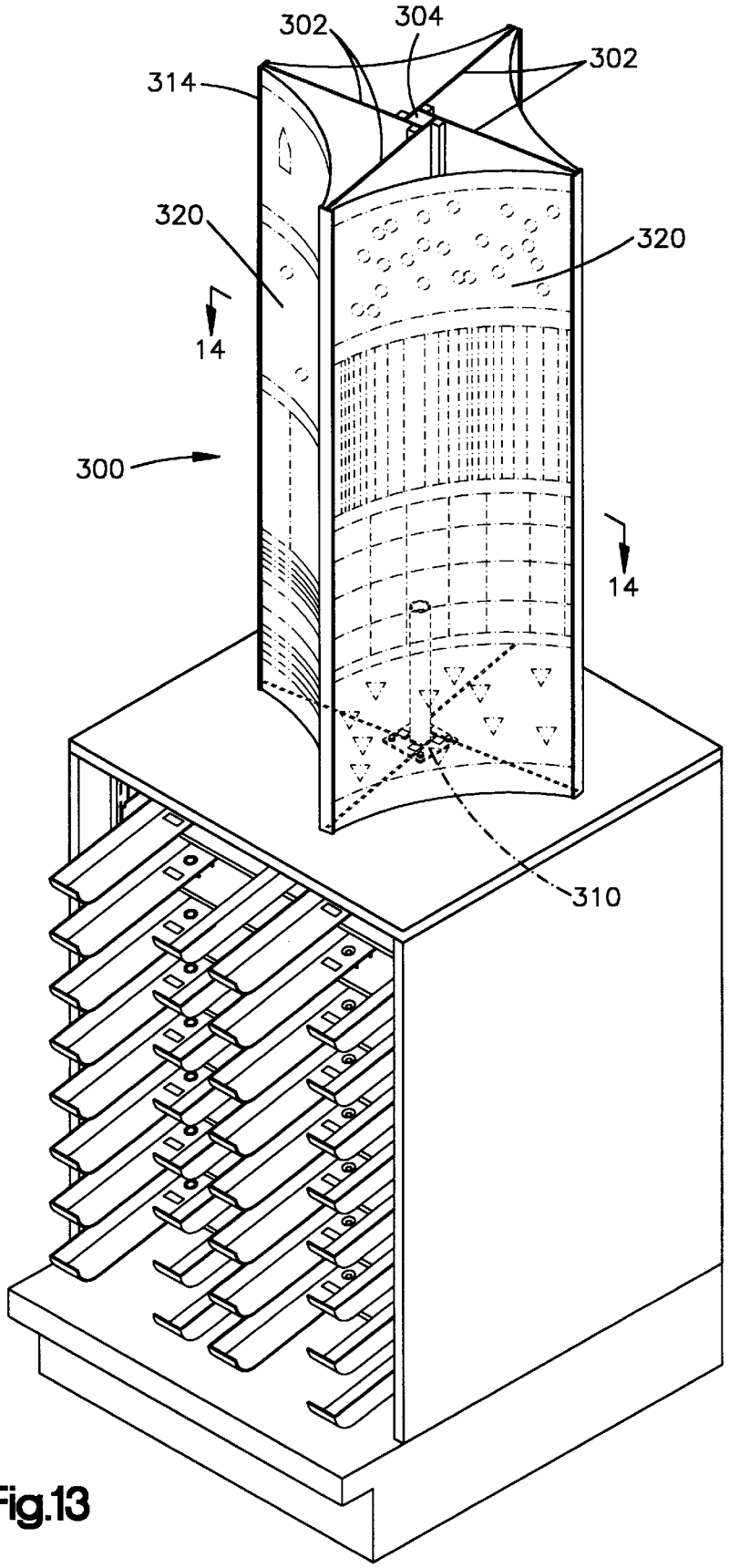
FIG. 13 is a perspective view of a roll cabinet shown in combination with a carousel constructed in accordance with the present invention.

FIGS. 13 and 14 illustrate another embodiment of the invention containing a carousel 300 shown in combination with a wallpaper roll display rack. The carousel 300 may also be utilized separate from the wallpaper display rack. The carousel 300 is utilized to display a series of wallpaper samples or wallpaper borders. The carousel 300 comprises a plurality of rigid panels 302 arranged to extend radially outward from a vertical axis 304 and forming a center hole for receiving a pole mounted upon a base 310. The carousel 300 is thus rotatable about the vertical axis 304. The distal edge 312 of each panel 302 further comprising flanges 314 having tabbed ends for retaining a flexible display panel 320 slidably received therein. When the display panels 320 are installed within the flanges 314, a concave mounting display surface is formed for mounting a plurality of wallpaper samples thereon. Because the mounting display surface is preferably concave, a greater amount of wallpaper surface area may be displayed.

Although described with reference to certain preferred and alternate embodiments, certain modifications and variations of the general principles of the invention which may be apparent to those of skill in the art are all within the scope of the invention as defined by the accompanying claims and equivalents thereto. For example, although shown in certain embodiments, the individual aspects of the system of the invention; such as the cassettes, the cassette display cabinet, the fixed and adjustable roll displays, the roll display cabinet, the fin assembly and the carousel, can be combined in any manner to provide different displays adaptable to any type of retail environment. Thus, the invention provides a highly adaptable product display system which is not limited to the particular combinations drawn herein. Furthermore, the proportions, dimensions and relative sizes of the combined display elements may be selectively varied in accordance with the invention.

I claim:

1. A fin assembly for displaying and storing merchandise, the fin assembly comprising:

a pivotally mounted elongate mounting panel having a first side and a second side;

the first side and second side each having an outer display compartment for displaying merchandise and an interior compartment having one or more pockets for storing merchandise.

2. The fin assembly of claim 1 further comprising a plurality of stepped spacers mounted on each side of said panel;

a plurality of separator clips mounted in between said spacers and forming an outer display compartment and one or more inner compartments.

3. The fin assembly of claim 1 wherein said inner compartment of said sample separator clip further comprises friction pins on an exterior surface for insertion into holes in said stepped spacers.

4. The assembly of claim 1 wherein said sample separator clip comprises flanges in said outer compartment and a resilient member for securing a clear cover over said outer compartment.

5. A display system for storing and displaying generally cylindrical objects together with samples of the objects, the display system comprising:

a plurality of roll trays vertically arranged for supporting generally cylindrical objects generally horizontally within the roll trays;

each roll tray having support trays which can support the generally cylindrical objects;

an elongate panel pivotally mounted adjacent a front of the roll trays; and at least one side of the panel having an outer compartment for displaying samples of the objects and an inner compartment having one or more pockets for storing additional samples of the objects.

6. The display system of claim 5, wherein at least two support trays can be adjusted to support cylindrical objects of different widths.

7. The display system of claim 6, wherein each of the adjustable support trays is slidably mounted on a panel having a track with spaced teeth and grooves between the teeth; and wherein each of the adjustable support trays has a resilient flap with a ratchet member positionable in one of the grooves.

8. A display assembly for storing and displaying samples of merchandise, the display assembly comprising:

a panel that is pivotally mounted to a display unit;

wherein the panel has an outer compartment and at least one inner compartment located horizontally behind the outer compartment;

wherein the outer compartment is configured to house a sample of merchandise for display to consumers of the merchandise; and wherein each inner compartment is configured to house additional samples of the merchandise for retrieval by the consumers of the merchandise.

9. The display assembly of claim 8, further comprising:

at least two spacers;

wherein each spacer is mounted on the panel; and wherein each spacer separates vertically adjacent outer compartments and inner compartments.

10. The display assembly of claim 9, further comprising:

at least one separator clip;

wherein each separator clip is mounted between vertically adjacent spacers; and wherein each separator clip forms one outer compartment and at least one inner compartment.

11. The display assembly of claim 10, wherein each separator clip comprises a pair of flanges and a pair of resilient members that form one outer compartment; and wherein the flanges and the resilient members hold the sample of merchandise for display to the consumers of the merchandise in place in the outer compartment.

12. The display assembly of claim 9, further comprising:

at least two friction pins;

wherein one friction pin is located on a top of one inner compartment and one friction pin is located on a bottom of the inner compartment; and wherein the top friction pin is inserted into a hole in the spacer vertically adjacent the top of the inner compartment and the bottom friction pin is inserted into a hole in the spacer vertically adjacent the bottom of the inner compartment.

13. A display system for storing and displaying generally cylindrical merchandise together with samples of the merchandise, the display system comprising:

at least one roll tray for supporting generally cylindrical merchandise;

a panel that is pivotally mounted adjacent a front of the roll tray;

wherein the panel has an outer compartment and at least one inner compartment located horizontally behind the outer compartment;

wherein the outer compartment is configured to house a sample of merchandise for display to consumers of the merchandise; and wherein each inner compartment is configured to house additional samples of the merchandise for retrieval by the consumers of the merchandise.

14. The display system of claim 13, wherein at least one roll tray is of an adjustable width for supporting generally cylindrical merchandise having different widths;

wherein each adjustable width roll tray has at least one left support tray and at least one corresponding right support tray; and wherein each corresponding left support tray and right support tray form a bin in the roll tray for supporting the generally cylindrical merchandise.

15. The display system of claim 14, wherein each left support tray and each right support tray is slidably mounted on a panel having a track of spaced grooves and teeth; and wherein each left support tray and each right support tray has a ratchet member that is positionable in the grooves between the teeth.

16. The display system of claim 13, wherein at least one roll tray is of a fixed width for supporting generally cylindrical merchandise having the same width; and wherein each fixed width roll tray has a left roll tray bracket and a corresponding right roll tray bracket.

17. The display system of claim 13, further comprising:

at least two spacers;

wherein each spacer is mounted on the panel; and wherein each spacer separates vertically adjacent outer compartments and inner compartments.

18. The display system of claim 17, further comprising:

at least one separator clip;

wherein each separator clip is mounted between vertically adjacent spacers; and wherein each separator clip forms one outer compartment and at least one inner compartment.

19. The display system of claim 18, wherein each separator clip comprises a pair of flanges and a pair of resilient members that form one outer compartment; and wherein the flanges and the resilient members hold the sample of merchandise for display to the consumers of the merchandise in place in the outer compartment.

20. The display system of claim 17, further comprising:

at least two friction pins;

wherein one friction pin is located on a top of one inner compartment and one friction pin is located on a bottom of the inner compartment; and wherein the top friction pin is inserted into a hole in the spacer vertically adjacent the top of the inner compartment and the bottom friction pin is inserted into a hole in the spacer vertically adjacent the bottom of the inner compartment.

* * * * *